US005447107A

United States Patent [19]

Iwaoka et al.

[11] Patent Number: 5,447,107

[45] Date of Patent: Sep. 5, 1995

[54] METALLIC TRANSPORTING APPLIANCE

[75] Inventors: Toshiaki Iwaoka; Hikari Yamauchi; Katumi Yamagishi, all of Yokohama, Japan

[73] Assignee: Iwaoka Kosakusho Co., Ltd., Kanagawa, Japan

[21] Appl. No.: 349,455

[22] Filed: Dec. 5, 1994

Related U.S. Application Data

[63] Continuation of Ser. No. 997,926, Dec. 29, 1992, abandoned.

[30] Foreign Application Priority Data

Dec. 30, 1991 [JP] Japan ..... 3-113686

[51] Int. Cl.[6] ..... B65D 19/00

[52] U.S. Cl. ..... 108/51.1; 52/673; 52/798.1

[58] Field of Search ..... 108/51.1, 51.3, 52.1; 52/670, 673, 675, 792, 814

[56] References Cited

U.S. PATENT DOCUMENTS

| | | | |
|---|---|---|---|
| 1,913,249 | 6/1933 | Sersen | 52/792 |
| 2,634,931 | 4/1953 | Weitzel | 108/51.1 |
| 3,000,603 | 9/1961 | Hemann | 108/51.3 |
| 3,597,891 | 8/1971 | Martin | 52/792 |
| 5,162,427 | 11/1925 | Waller | 52/673 |

FOREIGN PATENT DOCUMENTS

| | | | |
|---|---|---|---|
| 0293245 | 7/1965 | Netherlands | 52/673 |

*Primary Examiner*—Kenneth J. Dorner
*Assistant Examiner*—Gerald A. Anderson
*Attorney, Agent, or Firm*—Sandler, Greenblum & Bernstein

[57] ABSTRACT

A metallic transporting appliance, such as a flat pallet, a skid, or a box pallet, is designed so that a thin metal plate is used entirely for the pallet and skid and for the side wall of the box pallet. The thin metal plate is subjected to burring so as to have sufficient durability, thereby contributing to the reduction of the amount of wood for conventional wooden pallets in order to preserve natural resources. The metallic transporting appliance includes a main plate made from a thin metal plate having plural pairs of bores each formed at a predetermined interval therebetween in a flat surface thereof, with a slit formed between each pair of bores to couple the bore pair. The main plate has a plurality of elongated hole portions, each having a bottom hole with a flange provided by burring those portions where the bore pairs are coupled with the associated slits. This main plate is also adapted for the deck board of a skid. Lengthwise extending portions of the main plate are bent downwardly and then bent inwardly toward each other with a predetermined thickness, so that both end portions are joined at a center portion. The flanges of the elongated hole portions are welded to the extending portion by spot welding. This main plate is adapted for the deck board of a flat pallet or the side plate of a box pallet.

6 Claims, 14 Drawing Sheets

1
2
3
4
5
6
7
8
S
S'
L
L'
L''

1
2
4
5
6
7
S
L
L'

METALLIC TRANSPORTING APPLIANCE

This application is a continuation of application Ser. No. 07/997,926, filed Dec. 29, 1992, now abandoned.

BACKGROUND OF THE INVENTION

1) Field of the Invention

The present invention relates to metallic transporting appliances which reduce the amount of wood used in currently very popular wooden pallets for transportation usage, and therefore preserve natural resources.

2) Description of the Related Art

Of the conventional metallic transporting appliances of this type, pallets, such as flat pallets, skids or box pallets, made of wood are popular because they are easily scrapped and inexpensive to manufacture. The wooden pallets are also less expensive and lighter than metallic or plastic pallets. The wood for the pallets need not be of very high quality; that is, thin material such as lauan and larch may be used.

The wood used in the conventional transporting pallet appliances is in short supply in Japan, and a regular large demand even of thin material cannot be met fully, so that the manufacturers are currently dependent on importing such material. In this respect, metallic and plastic pallets have still been produced. The former pallets are assembled by arc welding on thick steel plates or by fastening by bolts. The latter are produced by a large injection molding machine using a large amount of molding material, making the cost significantly high. In addition, users are likely to have trouble in discarding the plastic pallets.

SUMMARY OF THE INVENTION

It is therefore an object of the present invention to provide a metallic transporting appliance, such as a flat pallet, a skid, or a box pallet, designed in such a way that a thin metal plate is used entirely for the pallet and skid and for the side wall of the box pallet. The thin metal plate is subjected to special burring so as to have sufficient durability, thereby contributing to the reduction of the amount of wood used for conventional wooden pallets in order to preserve natural resources.

To achieve the object and overcome conventional problems, according to the present invention, a metallic transporting appliance is provided which comprises a main plate made from a thin metal plate having plural pairs of bores, each formed at a predetermined interval therebetween in a flat surface thereof. A slit is formed between each pair of bores to couple the bore pair. The main plate has a plurality of elongated hole portions, each having a bottom hole with a flange provided by burring those portions where the bore pairs are coupled with the associated slits.

According to a second aspect of this invention, lengthwise extending portions of the main plate of the metallic transporting appliance of the first aspect are bent downward and then bent inward toward each other with a predetermined thickness. Both end portions are joined at a center portion, and the flanges of the elongated hole portions are welded to the extending portion by spot welding.

According to a third aspect of this invention, the main plate of the metallic transporting appliance of the first aspect constitutes a flat pallet type deck board. A link portion is defined at a predetermined interval by each lengthwise adjoining pair of elongated hole portions in a unit row, so as to be integral with another link portion defined at a predetermined interval by widthwise adjoining unit rows of elongated hole portions. Lengthwise extending portions of the main plate are bent downward and then bent inward toward each other with a predetermined thickness, both end portions are joined at a center portion, and the flanges of the elongated hole portions are welded to the extending portion by spot welding.

According to a fourth aspect of this invention, the main plate of the metallic transporting appliance of the first aspect includes a deck board of a skid type. The elongated hole portions are arranged radially on the main plate, and a link portion is defined at a predetermined interval by each lengthwise adjoining pair of elongated hole portions in a unit row, so as to be integral with another link portion defined at a predetermined interval by widthwise adjoining unit rows of elongated hole portions. A reinforcing plate is placed under the back of the main plate, and the flanges of the elongated hole portions are welded to the reinforcing plate by spot welding. Holes are made in four corners and at a center portion of the deck board and center portions of individual sides of the deck board between the associated corners. Restrictions are formed in four corners of the reinforcing plate, hat-shaped legs are welded to the holes of the deck board by spot welding, and the periphery of the deck board is curled downward to form a curl portion to hold the flanges of the legs.

According to a fifth aspect of this invention, the main plate of the metallic transporting appliance of the first aspect constitutes a side plate of a box pallet assembled by connecting the side plate to each peripheral edge of a deck board. Plural rows of elongated hole portions are arranged on the main plate as the side plate of the box pallet, and a link portion is defined at a predetermined interval by each lengthwise adjoining pair of elongated hole portions in a unit row, so as to be integral with another link portion defined at a predetermined interval by widthwise adjoining unit rows of elongated hole portions. Lengthwise extending portions of the main plate are bent downward and then bent inward toward each other with a predetermined thickness, both end portions are joined at a center portion, and the flanges of the elongated hole portions are welded to the extending portion by spot welding.

According to a sixth aspect of this invention, the main plate of the metallic transporting appliance of the first aspect and a reinforcing plate constitute a deck board of a skid type. Plural rows of elongated hole portions are provided in the main plate, and plural rows of elongated hole portions are provided in the reinforcing plate in a direction perpendicular to the plural rows of elongated hole portions of the main plate. The flanges of the elongated hole portions of the main plate are welded to the facing reinforcing plate by spot welding.

DETAILED DESCRIPTION OF THE PREFERRED EMBODIMENTS

Figure 1:
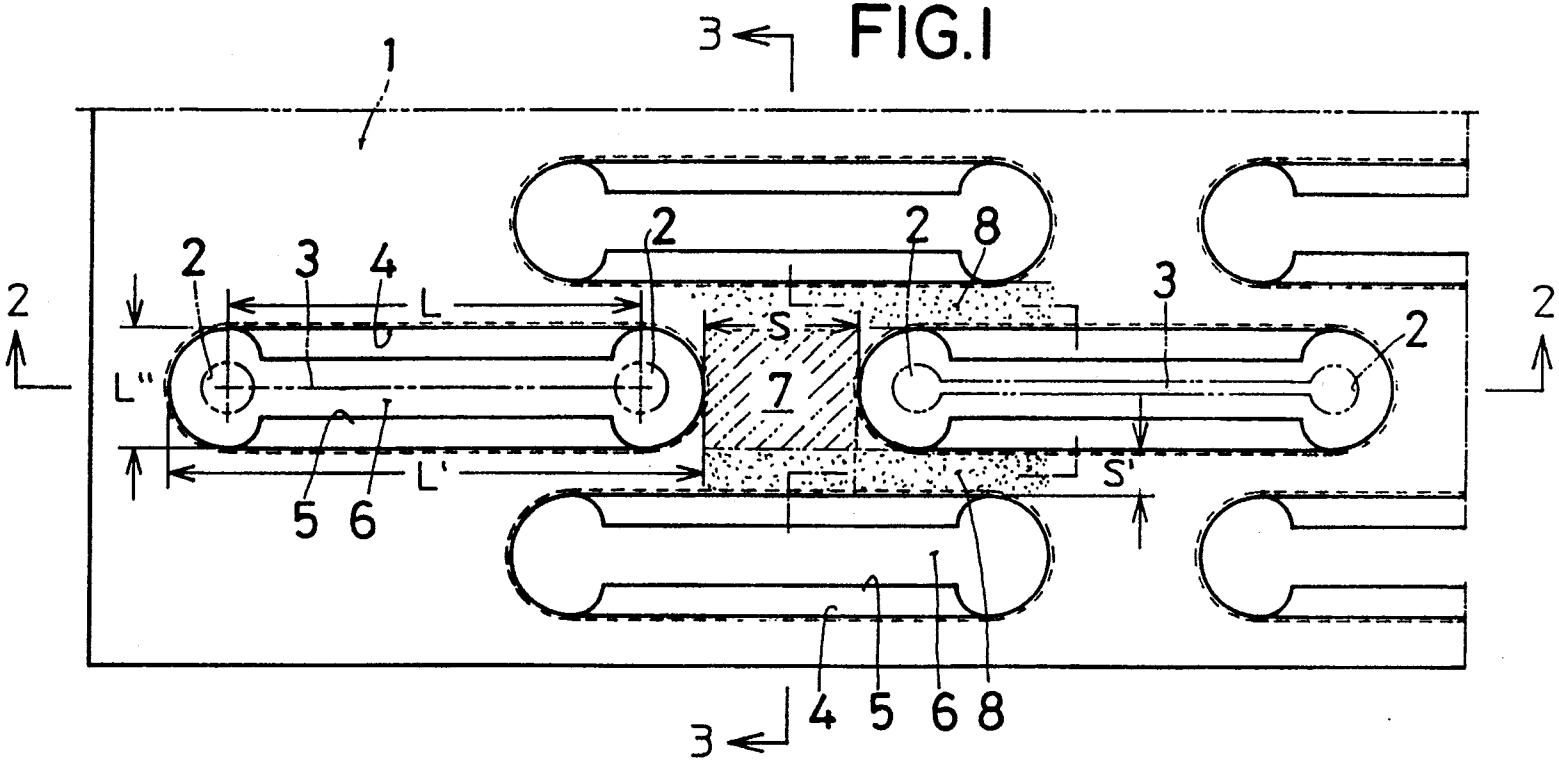
FIG. 1 is a plan view of a main plate made from a thin metal plate and having elongated hole portions formed therein by burring for use in a metallic transporting appliance according to the present invention.

Preferred embodiments of the present invention will now be described referring to the accompanying drawings.

FIGS. 1 through 4 illustrate a main plate to be adapted for a metallic transporting appliance and a board comprising the main plate according to a first embodiment of the present invention. The first embodiment is constructed as follows.

A main plate 1 is made from a thin metal plate of soft steel, aluminum alloy, or the like, with an arbitrary thickness. In the case of FIGS. 1 to 4, the allowable ratio of a long diameter to a short diameter ranges from about 4:1 to 5:1. The diameter of a bore is set to 20 mm, while the short diameter L″ is set to 35 mm for a long diameter L′ of 150 mm. When plural rows of elongated hole portions are provided, any two elongated hole portions 4 of a unit row adjoined lengthwise define a link portion 7. The distance S of this link portion 7 is set approximately the same as the above-mentioned short diameter L″, and any elongated hole portion in a unit row and part of an associated elongated hole portion of an adjoining unit row defines a link portion 8 whose distance S′ is set approximately $\frac{1}{3}$ of the short diameter L″.

Lengthwise extending portions $1_1$ of the main plate 1 are bent with a predetermined thickness t and are then bent inwardly toward each other, thus constituting a board. As a flat pallet or a deck board of a skid normally has a thickness t of about 20 mm, the elongated holes 4 in this embodiment are formed in accordance with the thickness t of the board. Flanges 5 of the elongated hole portions 4 are securely welded to the extending portions $1_1$ (see W in FIG. 4).

The elongated hole portions 4 are formed through burring. "Burring" is a hole-flange process which generally forms a cylindrical shape with a cylindrical male portion and its mating female portion by using circumferential stretching of a single complete circle. Drawing using such burring is also known. In this embodiment, a slit 3 is formed between bores 2 which are formed with a distance L between their centers, and the resultant structure is then subjected to burring, thus forming a flange 5 around a bottom hole 6 or at least at a long side portion.

The main plate 1 which is made from a thin metal plate is provided with plural rows of elongated hole portions 4 in such a way that the link portion 7 of the lengthwise adjoining elongated hole portions 4 of one row, which has a predetermined interval S, is integrally formed with the link portion 8 of parts of the two subsequent elongated hole portions 4 of another row adjoined to that row with a predetermined interval S′ therebetween.

Figure 4:
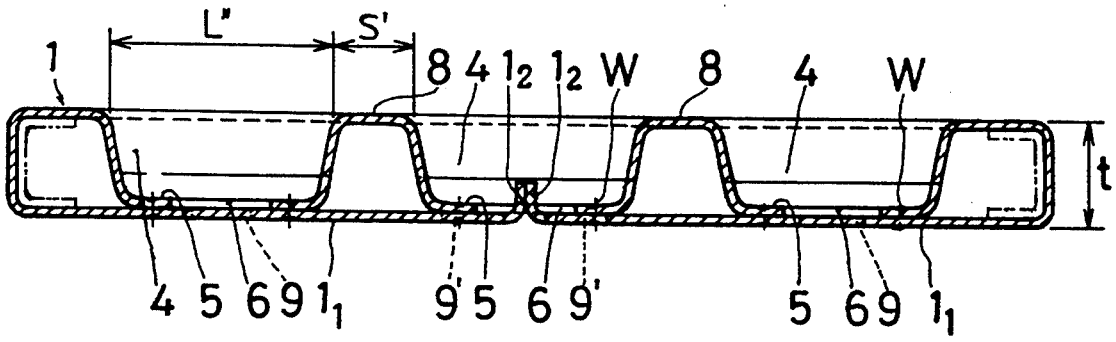
FIG. 4 is a lateral cross section of burred portions of a board having the main plate of FIGS. 1 to 3 and formed with predetermined thickness.
Figure 5:
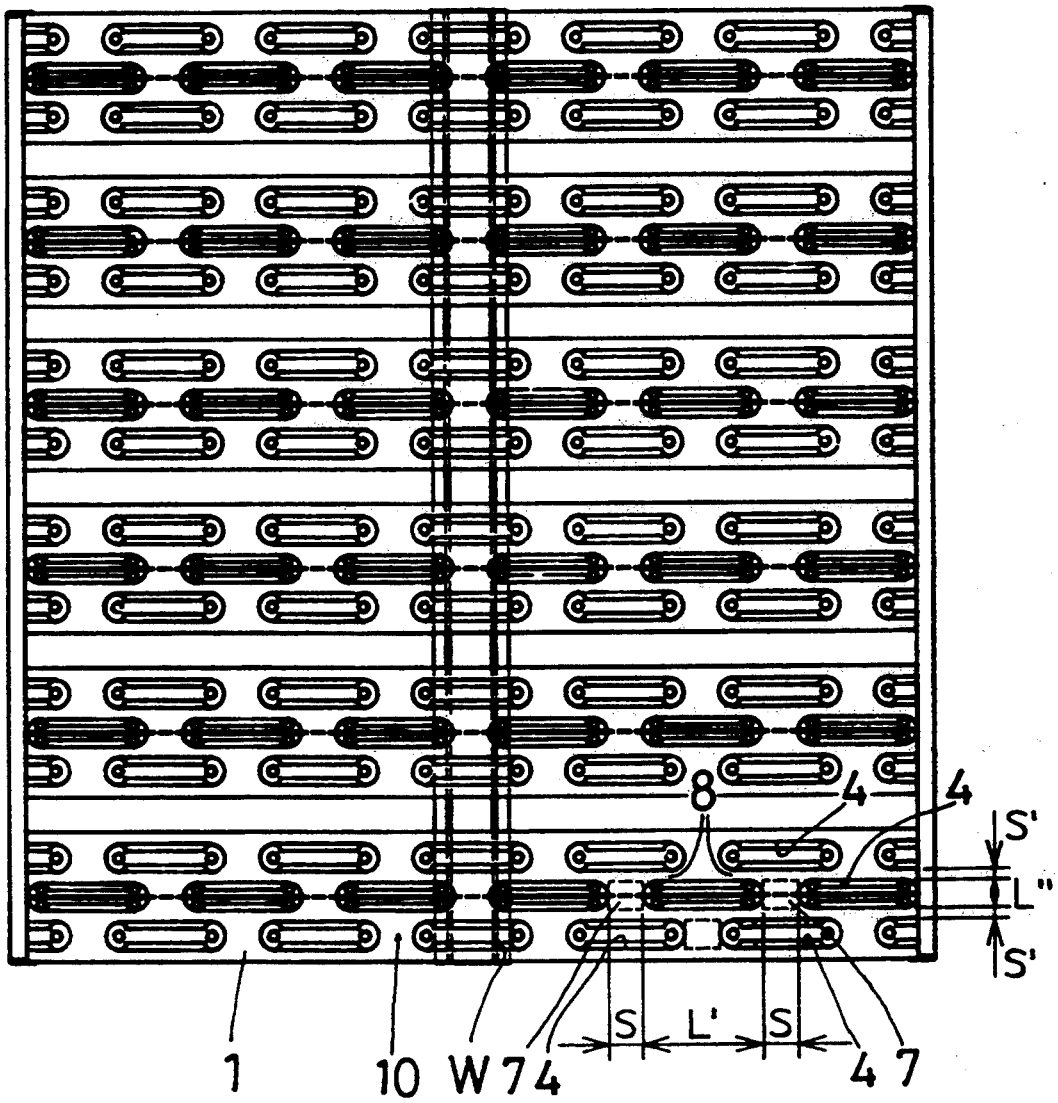
FIG. 5 is a plan view of a metallic flat pallet to which the board shown in FIGS. 1 to 4 after burring is adapted.
Figure 6:
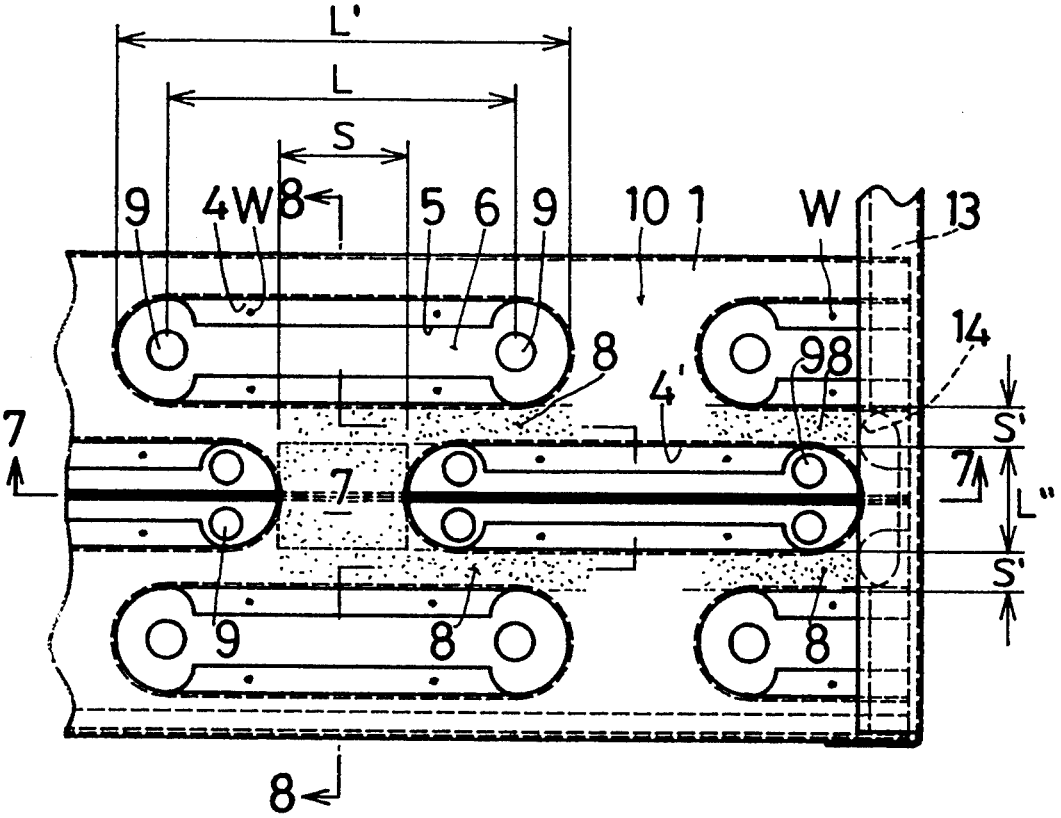
FIG. 6 is an enlarged view showing part of FIG. 5.
Figure 7:
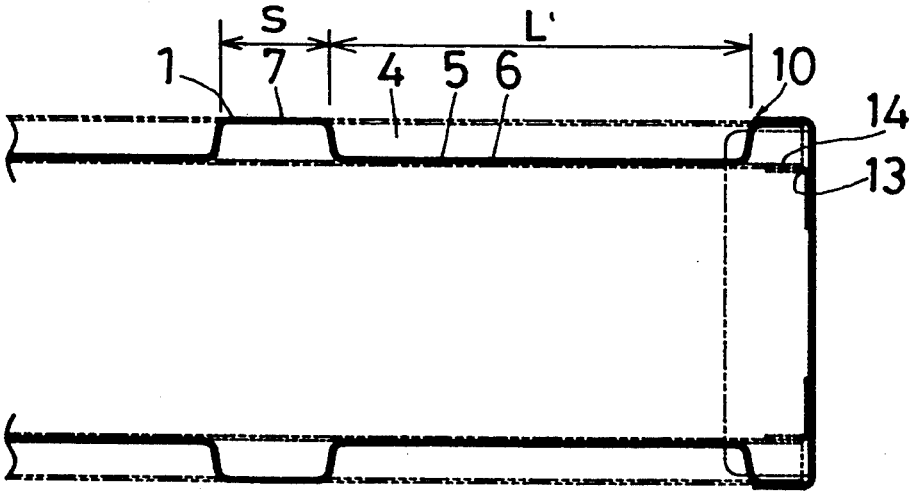
FIG. 7 is a cross section taken along line 7—7 in FIG. 6.
Figure 8:
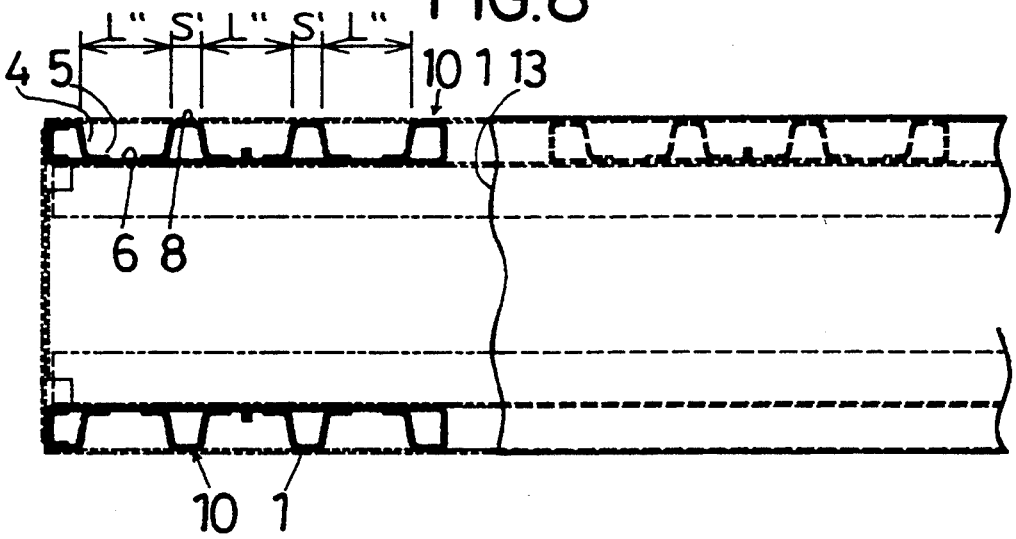
FIG. 8 is a cross section taken along line 8—8 in FIG. 6.
Figure 9:
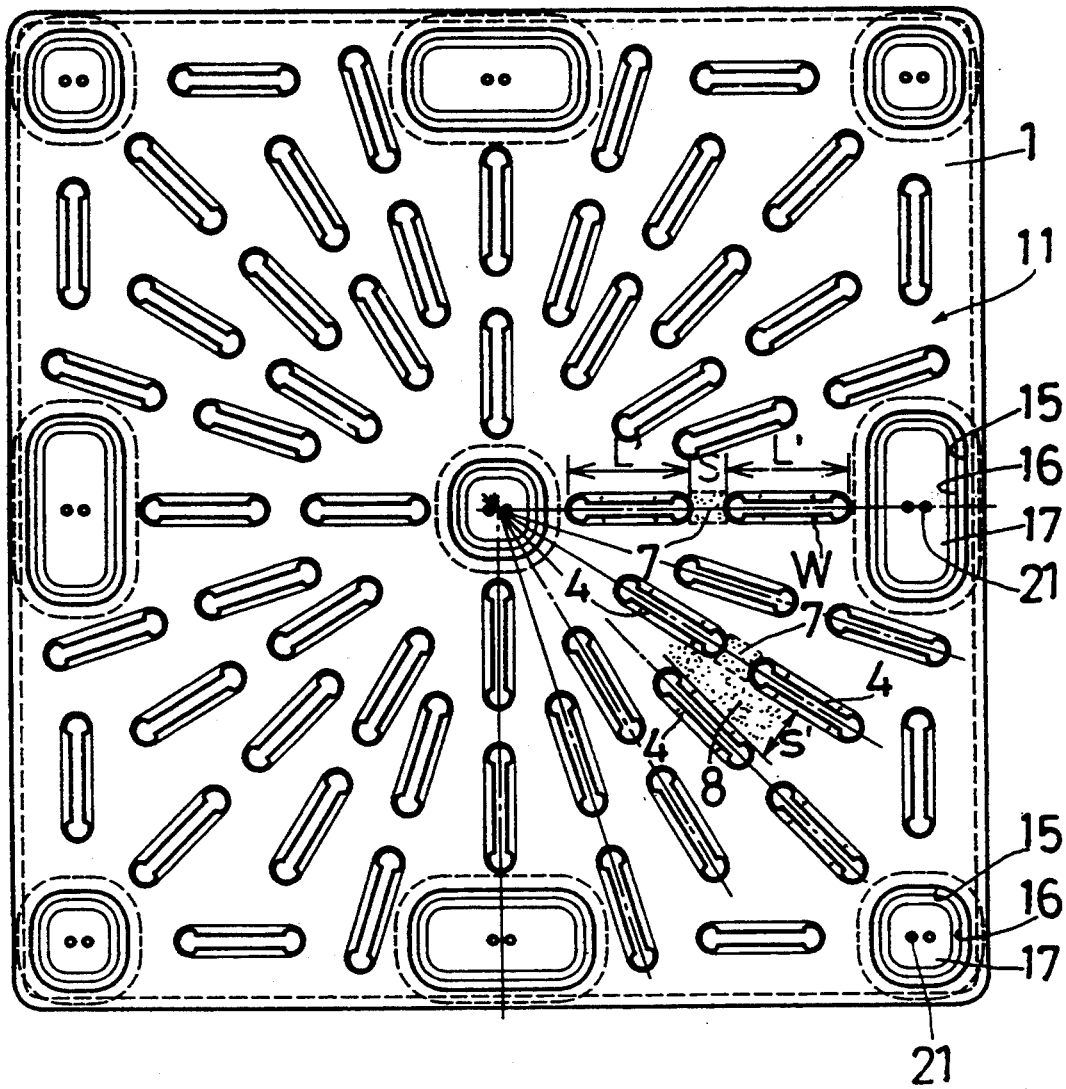
FIG. 9 is a plan view of a metallic skid to which a main plate after burring is adapted.
Figure 10:
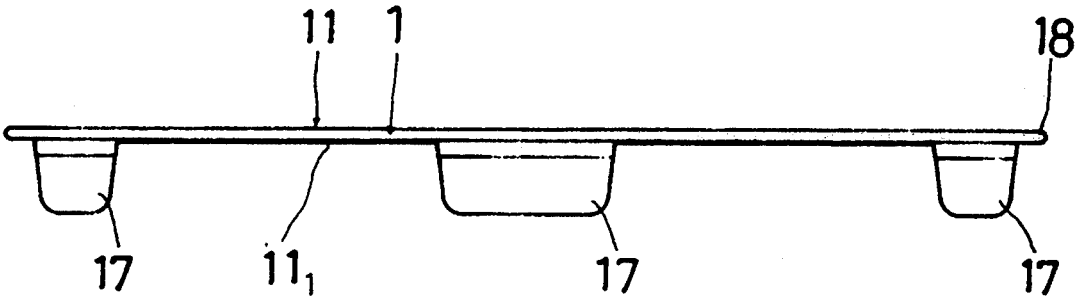
FIG. 10 is a front view of FIG. 8.
Figure 11:
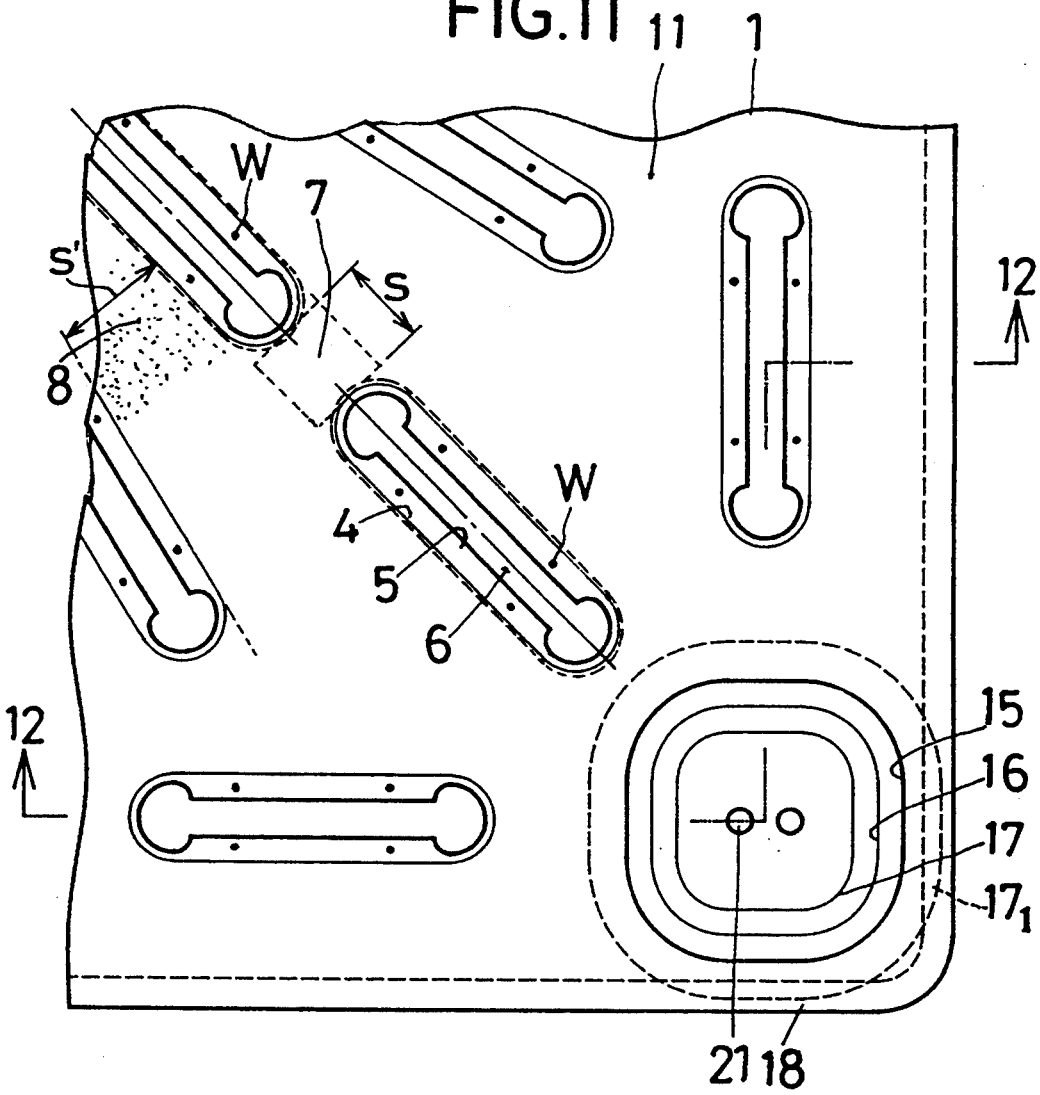
FIG. 11 is an enlarged plan view showing part of FIG. 9.
Figure 12:
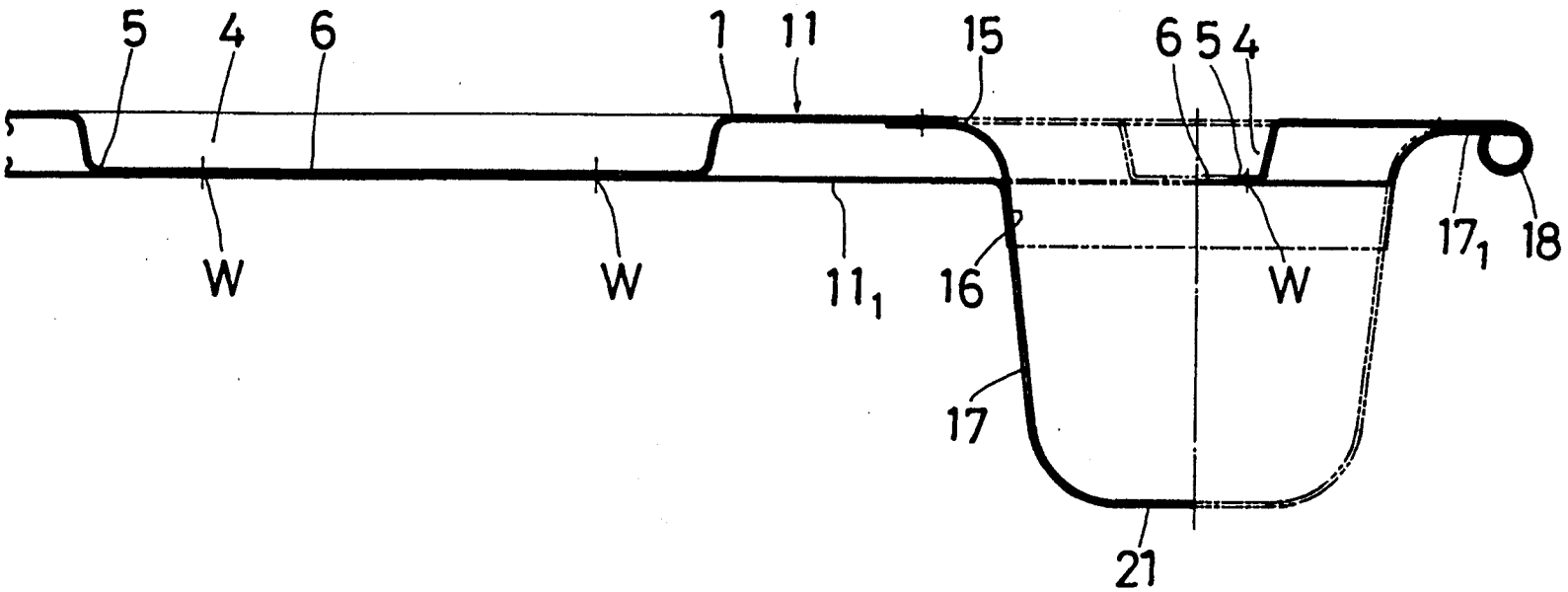
FIG. 12 is a cross section taken along line 12—12 in FIG. 11.

In FIG. 4, the lengthwise extending portions $1_1$ of the main plate 1 in FIG. 1 are bent downward and then bent inwardly toward each other with a predetermined thickness t, and both end portions $1_2$ are connected at the center portion, thus constituting a board.

The flanges 5 of the elongated hole portions are secured at several points (W) to the extending portions $1_1$ by spot welding.

FIGS. 5 through 8 illustrate a flat pallet constituted by a board, which is constructed by forming a plurality of elongated holes 4 in the main plate 1 which is made from a thin metal plate as shown in FIGS. 1 to 4. A deck board 10 is constructed by arranging a plurality of such boards. The board is constructed by folding the lengthwise extending portions $1_1$ of the main plate 1 provided with the elongated inward holes 4, connecting both end portions $1_2$ at the center portion, and fixing the flanges 5 of the elongated hole portions to the extending portions $1_1$ by spot welding (see W).

Multiple boards thus formed are arranged with the proper intervals therebetween. Each board is provided with three rows of elongated holes 4 in such a way that the link portion 7 of the lengthwise adjoining elongated holes 4 of one row, which has a predetermined interval S, is integrally formed with the link portion 8 of parts of the two subsequent elongated holes 4 of another row adjoined to that row, with a predetermined interval S′ therebetween.

The above flat pallet has beams 13 for supporting both deck boards 10, each comprising multiple boards and each formed by the main plate 1. Clearance grooves 14 are formed in those portions of the beams where the deck boards are supported. When the individual deck boards are assembled to the beams 13, chips for spot welding are inserted through the clearance grooves 14.

Figure 2:
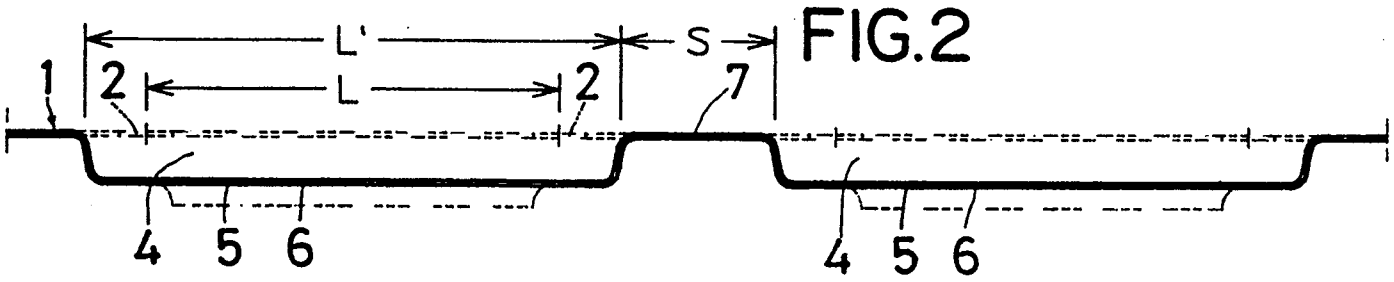
FIG. 2 is a cross section taken along line 2—2 in FIG. 1.
Figure 3:
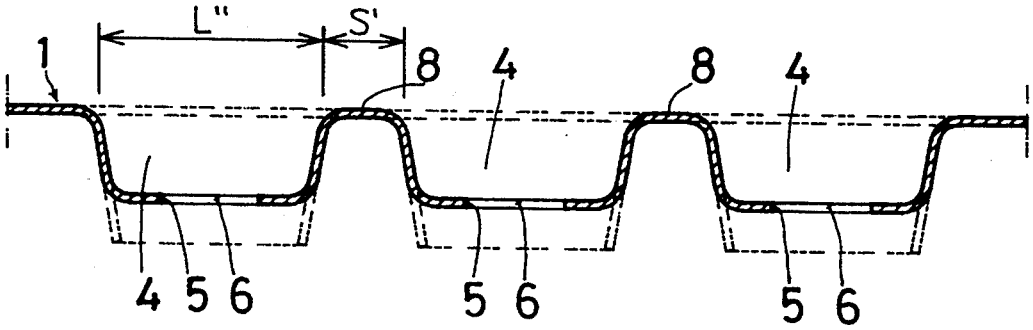
FIG. 3 is a cross section taken along the line 3—3 in FIG. 1.

FIGS. 9 through 12 illustrate a skid comprising a deck board constituted by the main plate 1, which is made from a thin metal plate as shown in FIGS. 1 to 3, and has elongated hole portions formed radially therein. A reinforcing plate $11_1$ is placed at the bottom of the main plate 1. The elongated hole portions 4 with flanges are radially formed from the center portion of the deck board 11. The flanges 5 of the elongated hole portions are fixed to the reinforcing plate $11_1$ by spot welding (see W in FIG. 12).

Holes 15 are formed in the four corners and the center portion of the deck board 11 and center portions of the individual sides of the deck board between the associated corners. Restrictions $15_1$ are formed in the four corners of the reinforcing plate $11_1$, hat-shaped legs 17 are fitted into the restrictions $15_1$, and flanges $17_1$ of the legs are welded to the holes 15 of the deck board by spot welding. The periphery of the deck board 11 is curled downward to form a curl portion 18 that holds the flanges $17_1$ of the legs 17. In the figures, reference numeral 21 is a drain hole formed in each leg 17.

Figure 13:
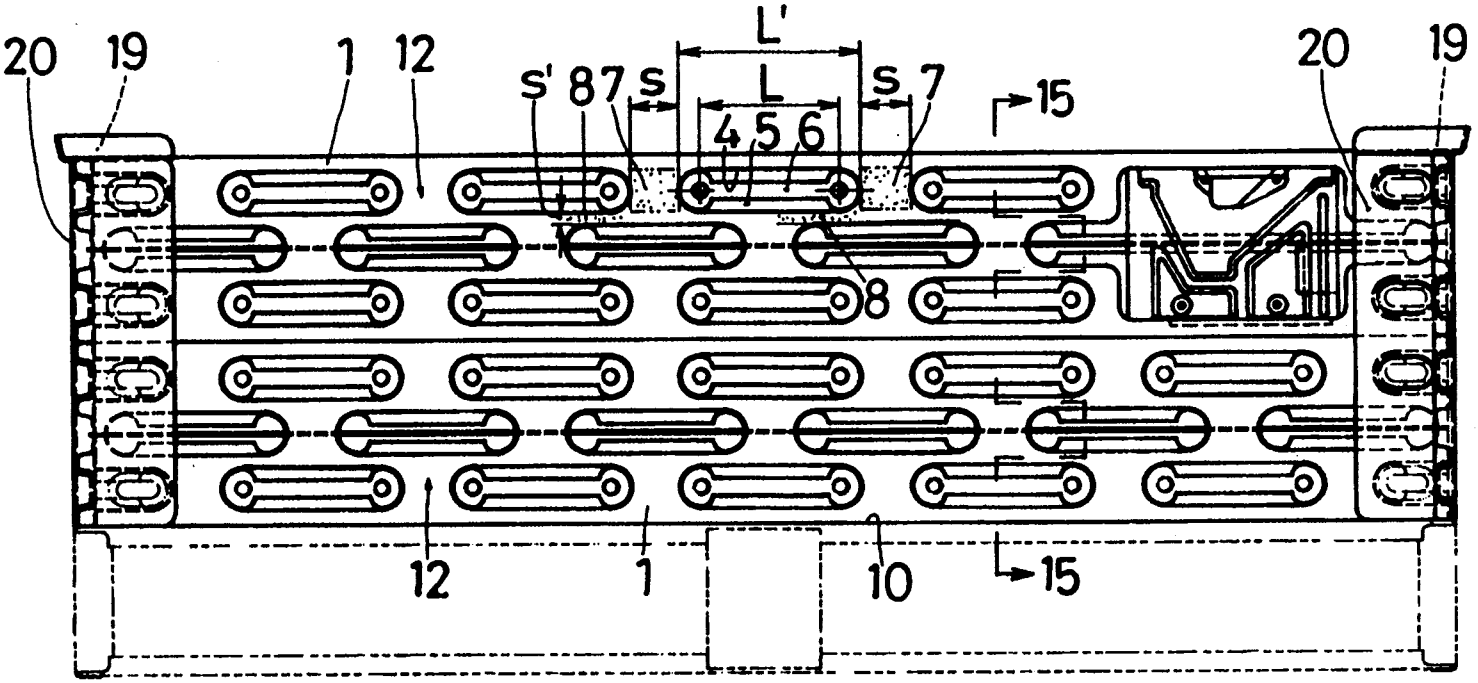
FIG. 13 is a front view of a side plate for a box pallet to which a board after burring is adapted.
Figure 14:
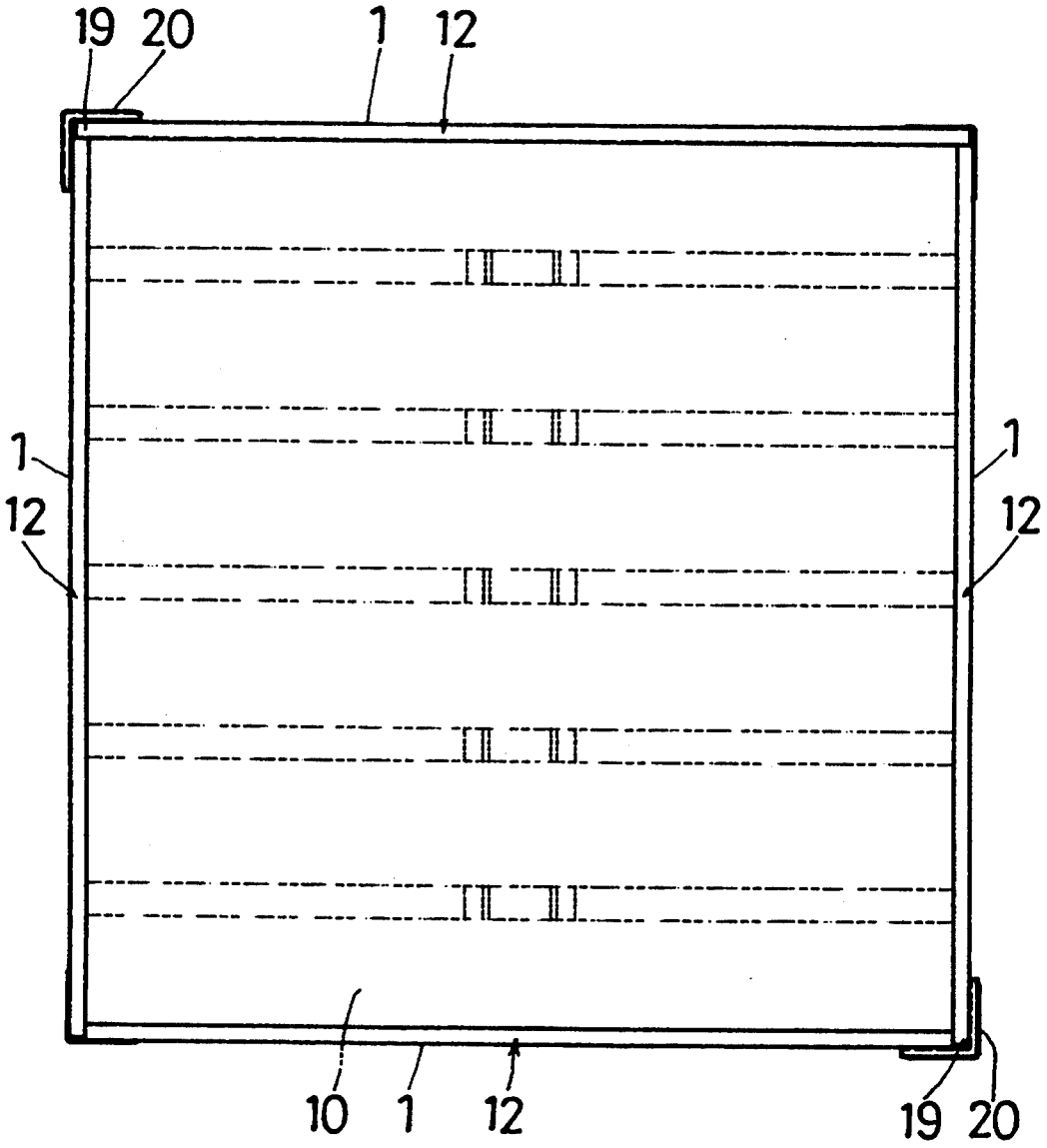
FIG. 14 id s plan view of FIG. 13.
Figure 15:
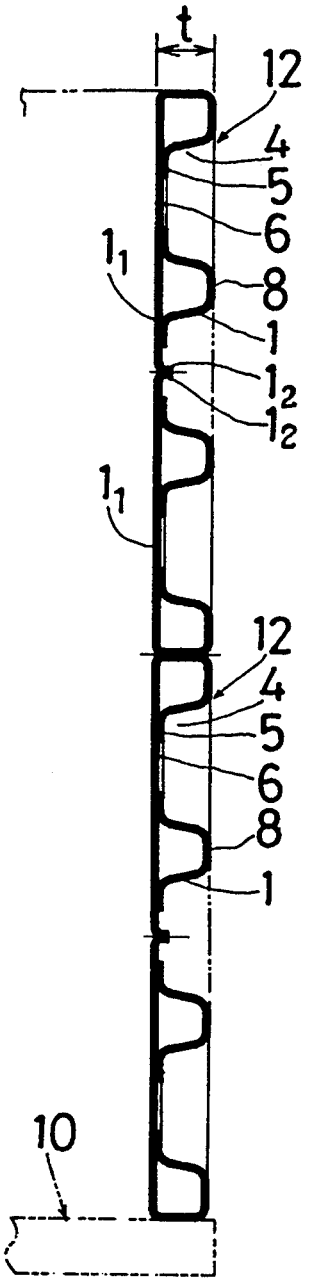
FIG. 15 is an enlarged cross section taken along line 15—15 in FIG. 13.
Figure 16:
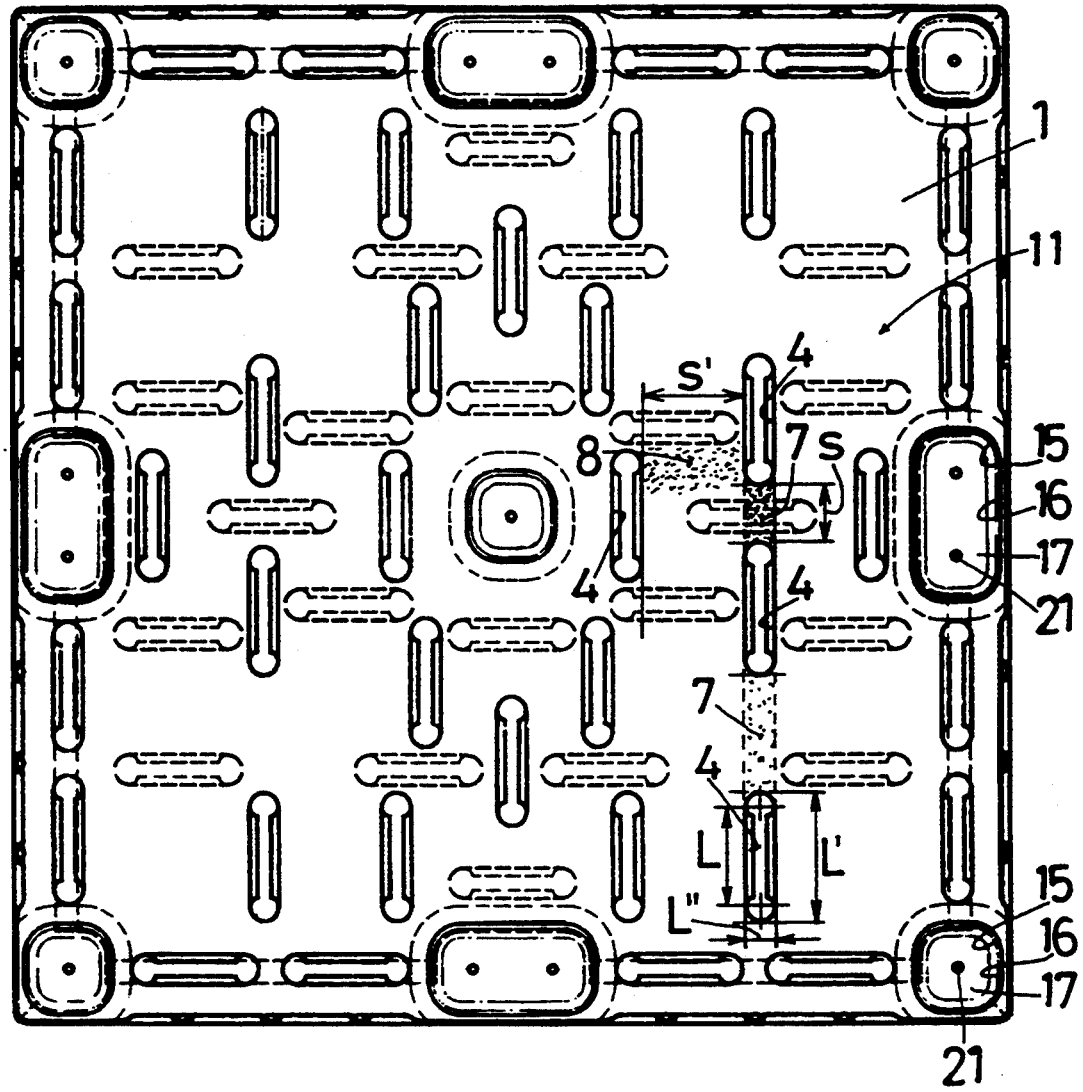
FIG. 16 is a plan view showing another example of the skid shown in FIGS. 9 to 12.
Figure 17:
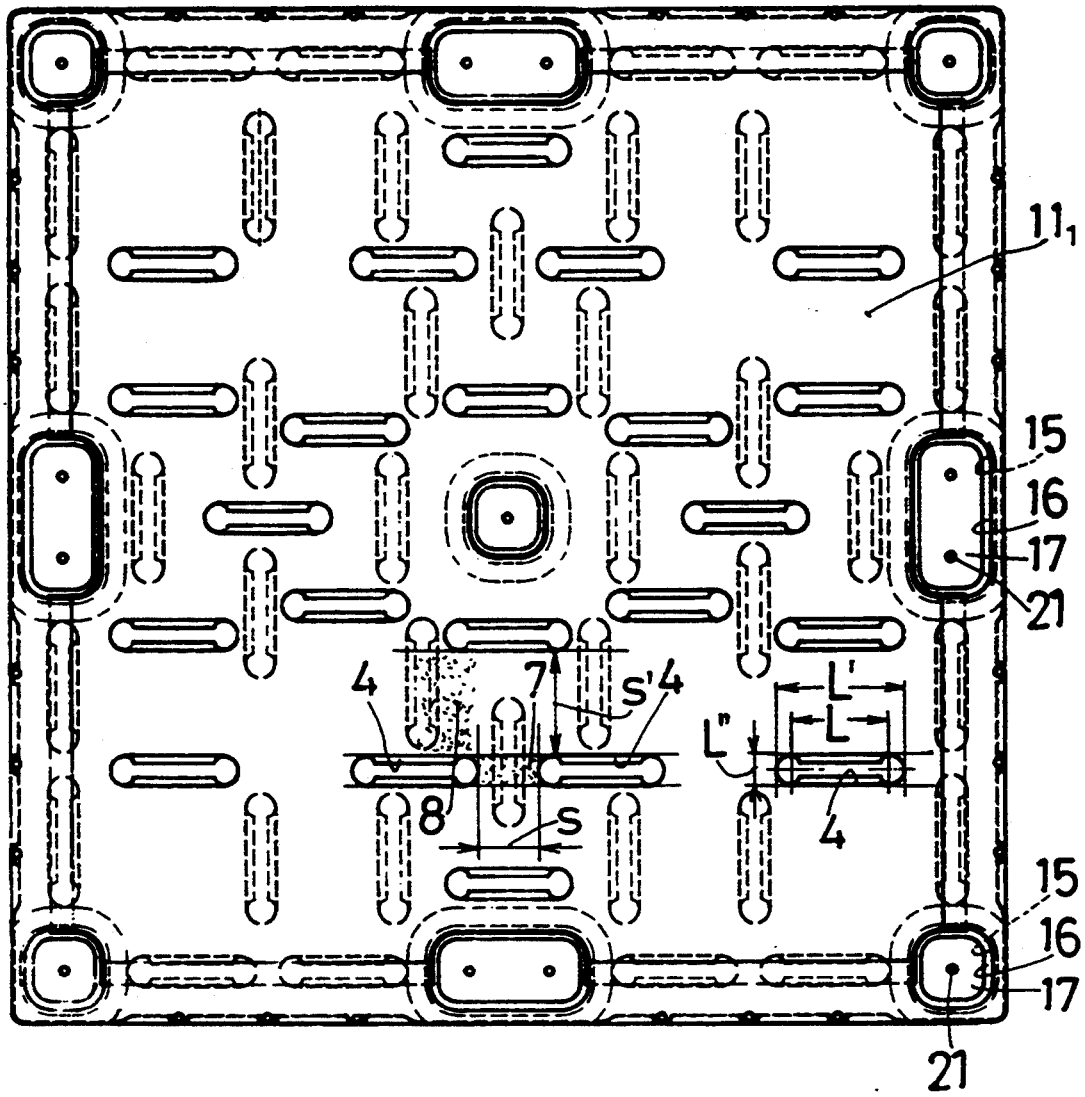
FIG. 17 is a bottom view of FIG. 16.
Figure 18:
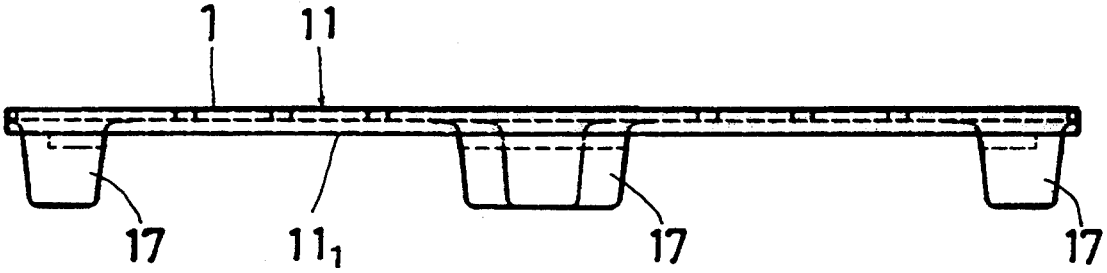
FIG. 18 is a front view of FIG. 16.
Figure 19:
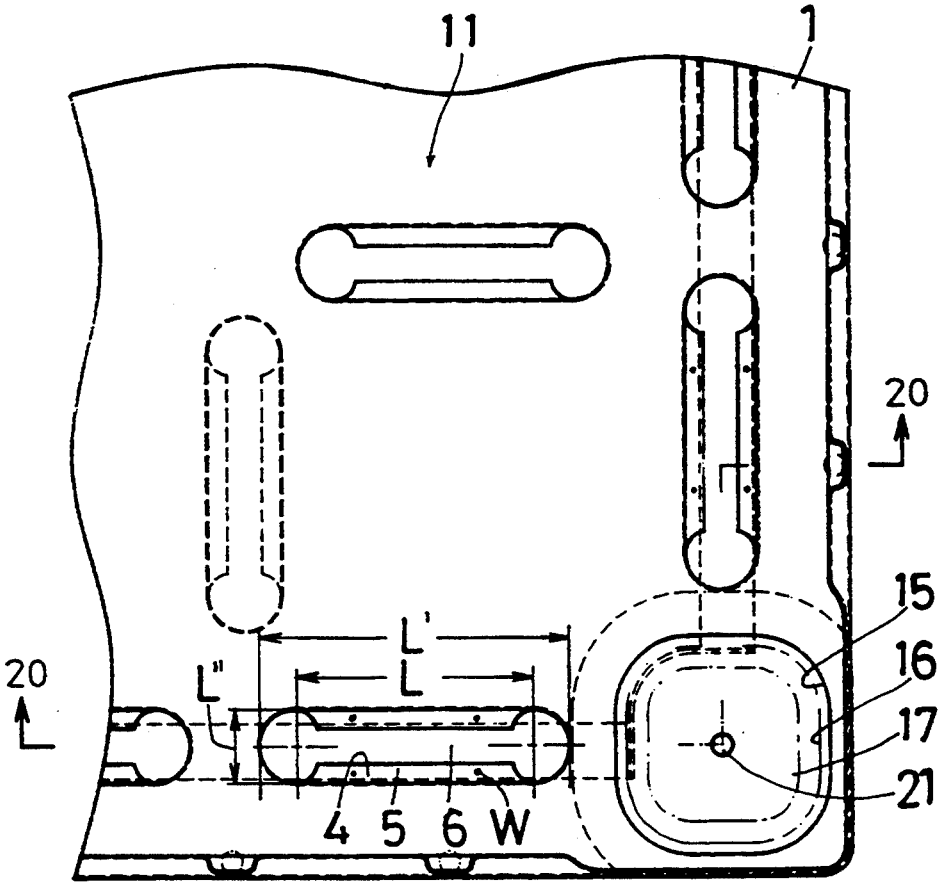
FIG. 19 is an enlarged plan view showing part of FIG. 16.
Figure 20:
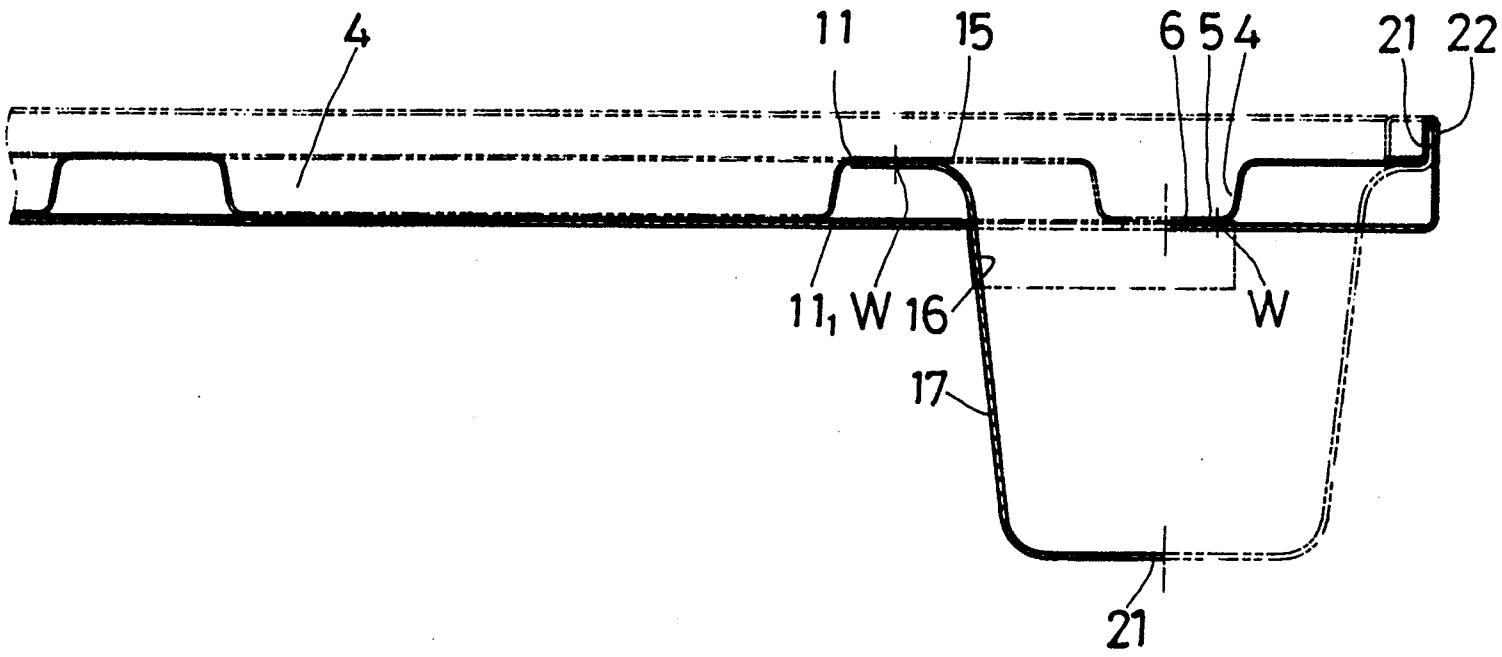
FIG. 20 is a cross section taken along line 20—20 in FIG. 19.

FIGS. 13 to 15 illustrate a box pallet to which the board shown in FIGS. 1–4 is adapted. A side plate 12 has two plates placed one on the other in the height or vertical direction, and a single row of elongated hole portions 4 and plural rows of elongated hole portions 4 are formed in the side plate.

The lengthwise extending portions $1_1$ of the main plate 1 made from a thin metal plate are bent downward and then bent inwardly toward each other with a predetermined thickness t. Both end portions $1_2$ are connected at the center portion, thus forming a board, and the flanges 5 of the elongated hole portions are secured at several points (W) to the extending portions $1_1$ by spot welding.

A pair of diagonally opposite corners of the box pallet at the top are provided with legs 20 having receiving portions 19 for receiving another box pallet.

FIGS. 16 to 20 illustrate another example of the skid shown in FIGS. 9–12. The deck board 11 comprises the main plate 1 and the reinforcing plate $11_1$. Plural rows of elongated hole portions 4 are provided in the main plate 1, and plural rows of elongated hole portions 4 are provided in the reinforcing plate $11_1$ in a direction perpendicular to the plural rows of elongated hole portions 4 of the main plate. The flanges 5 of the elongated hole portions of the main plate 1 are fixed to the facing reinforcing plate $11_1$ by spot welding (see W in FIG. 20).

The holes 15 are formed in the four corners and the center portion of the deck board and center portions of individual sides of the deck board between the associated corners by burring. Restrictions $15_1$ are formed in the four corners of the reinforcing plate $11_1$, hat-shaped legs 17 are fitted into the restrictions, and the flanges of the legs 17 are welded to the peripheral portions of the holes 15 of the deck board by spot welding. The periphery of the deck board is bent upward to form projections 21 and 22 that hold the flanges of the legs.

Specific manufacturing processes according to the present invention will now be described by referring to FIGS. 1 through 4. First, plural pairs of bores 2 are each formed at a predetermined interval L therebetween in the flat surface of the main plate 1 which is made from a thin metal plate and constitutes an essential portion of an assembly of a metallic transporting appliance. Next, the slit 3 is formed between each pair of bores 2 to join the bore pair. Then, the regions around and between both bores 2 are subjected to burring to provide elongated hole portions, and at the time of forming these hole portions, the flange 5 is formed around or part (long side portion) of each relatively shallow bottom hole. The flange forms a shallow bottom.

Plural rows of the elongated hole portions 4 are arranged in the main plate 1. The link portion 7, with a predetermined interval S between each lengthwise adjoining pair of elongated hole portions in a unit row, is formed so as to be integral with another link portion 8 with a predetermined interval S' defined between parts of the elongated hole portions of a widthwise adjoining unit row.

The main plate 1 shown in FIGS. 1 to 3 is adapted for use in a skid having the elongated hole portions 4 radially arranged as shown in FIGS. 9 to 12, or a skid having the elongated hole portions 4 arranged in plural rows as shown in FIGS. 16 to 20. In this case, the reinforcing plate $11_1$ is placed at the bottom of the deck board 11 formed by that main plate, and the flanges 5 of the elongated hole portions are fixed to the reinforcing plate by spot welding (see W).

In FIG. 4, the lengthwise extending portions $1_1$ of the main plate 1 shown in FIGS. 1 to 3 are bent downward and then bent inwardly toward each other with a predetermined thickness t. Both end portions $1_2$ are connected at the center portion, and the flanges 5 of the elongated hole portions are secured to the extending portions $1_1$ by spot welding (see W), thus forming a board. Plural rows of the boards are arranged as shown in FIGS. 5–7 and 13–15 to form the deck board 10 of a flat pallet or a side plate 12 of a box pallet.

With the above-described structure, according to a first aspect of the present invention, the main plate is made from a thin metal plate, so that even when it is applied to any type of pallet, a skid, or other metallic transporting appliances, the strength of the main plate, though light, is increased to provide high durability. Furthermore, the height of the elongated hole portions of the board can be set to the proper thickness, for example, about 10 to 30 mm.

The board is reinforced by multiple elongated hole portions provided in the main plate, and reinforcement is further improved by the flanges formed in the bottom holes. Furthermore, in the case of a flat pallet, the board can be stably mounted and coupled to the beams. The link portion between the lengthwise adjoined elongated holes 4 of one row is formed so as to be integral with the two subsequent elongated holes of another row adjoined to that row. Although the elongated hole portions occupy more that one half of the area of the thin metal plate, the board has sufficient strength against a load applied to the loading surface or the side wall.

In addition, since no wood is used, this board is expected to contribute to preservation of natural resources.

According to a second aspect of this invention, the lengthwise extending portions of the main plate of the first aspect are bend downward and then inwardly bent toward each other at a predetermined thickness, and both end portions are coupled at the center, thus yielding a board with an arbitrary thickness and improved strength.

In a flat pallet according to a third aspect of this invention, the board formed by the main plate of the first aspect or the second aspect is adapted for a deck board, so that the elongated hole portions occupy more than one half of the area of the thin metal plate, contributing to considerable reduction of the weight of the pallet. Furthermore, the link portion between the lengthwise adjoined elongated holes of one row is formed so as to be integral with the two subsequent elongated holes of another row adjoined to that row, so that the board has sufficient strength against a live load, and those portions which become locally weak against a load can be reinforced to provide higher strength.

As clearance grooves are formed at the portions of beams which support the deck board at the time of assembling the deck board to the beams, welding chips for a spot welding machine can be easily inserted, thus eliminating the need for fastening by bolts, arc welding, or the like, so that a very neat and smart flat pallet can be formed.

In a skid according to a fourth aspect of this invention, the elongated hole portions are formed radially in the deck board. A link portion is defined at a predetermined interval by each lengthwise adjoined pair of elongated hole portions in a unit row, so as to be integral with another link portion defined at a predetermined interval by widthwise adjoined unit rows of elongated hole portions. Therefore, as with the effect of the third aspect, the elongated hole portions occupy more than one half the loading surface, thus contributing to considerable reduction of weight, and the link portion between the lengthwise adjoined elongated holes of one row is formed so as to be integral with the two subsequent elongated holes of another row adjoined to that row, so that the board has sufficient strength against a live load. Furthermore, a reinforcing plate is placed at those portions which become locally weak against a load and the flanges of the elongated hole portions are welded to the reinforcing plate by spot welding, so that the board is sufficiently reinforced to provide higher strength.

In the frame of a box pallet according to a fifth aspect of this invention, the boards of the first aspect and second aspect are adapted for the side plate of a box pallet. A unit board can be formed by a main plate made from a single thin metal plate. The weight is reduced by the elongated hole portions. As flanges are formed in the elongated hole portions, and the link portion between the lengthwise adjoined elongated holes of one row is formed so as to be integral with the two subsequent elongated holes of another row adjoined to that row, reinforcement is improved to provide higher durability.

In a skid according to a sixth aspect of this invention, the deck board is formed by the main plate and the reinforcing plate. Plural rows of elongated hole portions are provided in the main plate, plural rows of elongated hole portions are provided in the reinforcing plate in a direction perpendicular to the plural rows of elongated hole portions of the main plate, and the flanges of the elongated hole portions of the main plate are welded to the facing reinforcing plate by spot welding. Therefore, as with the effect of the third aspect, the elongated hole portions occupy more than one half the loading surface, contributing to considerable reduction of weight. The link portion between the lengthwise adjoined elongated holes of one row is formed so as to be integral with the two subsequent elongated holes of another row adjoined to that row, so that the board has sufficient strength against a live load. Furthermore, since a reinforcing plate is placed at those portions which become locally weak against a load, and the flanges of the elongated hole portions are welded to the reinforcing plate by spot welding, the board is sufficiently reinforced to provide higher strength.

What is claimed is:

1. A metallic transporting appliance comprising:

a main plate made from a metal plate, said metal plate including plural pairs of bores, each pair of bores being formed in a flat surface of said metal plate, a slit being formed between each bore of said pair of bores to couple said pair of bores, said main plate having a plurality of elongated depressions each having a bottom with a flange, said flange being formed by burring the portions where said pair of bores are coupled with respective slits; and wherein said main plate includes two lengthwise extending portions and two end portions, said lengthwise extending portions being bent downwardly and then bent inwardly toward each other, both end portions being joined at a center portion, and each said flange of each said elongated depression portion being welded to said lengthwise extending portion by spot welding.

2. The metallic transporting appliance according to claim 1, wherein said main plate forms a side plate of a box pallet, said box pallet being assembled by connecting said side plate to each peripheral edge of a deck board, plural rows of elongated depressions being arranged on said main plate, a link portion being formed by each adjoining pair of elongated depressions in a first unit row, so as to be integral with another link portion defined by second adjoining unit rows of elongated depressions, said lengthwise extending portions of said main plate being bent downwardly and then bent inwardly toward each other, said end portions being joined at a center portion, and said flanges of said elongated depressions being welded to said lengthwise extending portion by spot welding.

3. A metallic transporting appliance comprising:

a main plate made from a metal plate, said metal plate including plural pairs of bores, each pair of bores being formed in a flat surface of said metal plate, a slit being formed between each bore of said pair of bores to couple said pair of bores, said main plate having a plurality of elongated depressions each having a bottom with a flange, said flange being formed by burring the portions Where said pair of bores are coupled with respective slits.

4. The metallic transporting appliance according to claim 3, wherein said main plate includes two lengthwise extending portions and two end portions and forms a flat pallet deck board, a link portion being foamed by each pair of elongated depressions in a first unit row, so as to be integral with another link portion formed by second adjoining unit rows of elongated depressions, said second adjoining unit rows being transversely located With respect to said first unit row, said lengthwise extending portions of said main plate being bent downwardly and then bent inwardly toward each other, both end portions being joined at a center portion, and each said flange of each said elongated depression being welded to said lengthwise extending portion by spot welding.

5. The metallic transporting appliance according to claim 3, wherein said main plate forms a deck board of a skid, said elongated depressions being radially arranged on said main plate, a link portion being formed by each pair of elongated hole portions in a unit row, so as to be integral with another link portion formed by adjoining unit rows of elongated depressions, a reinforcing plate being placed under said main plate, said flanges of said elongated depressions being welded to said reinforcing plate by spot welding, holes being formed in four corners and a center portion of said deck board and center portions of individual sides of said deck board between respective corners, restrictions being formed in said four corners of said reinforcing plate, hat-shaped legs being fitted into said restrictions, flanges of said legs being welded to said holes of said deck board by spot welding, and periphery of said deck board being curled downwardly to form a curl portion to hold said flanges of said legs.

6. The metallic transporting appliance according to claim 3, wherein said main plate and reinforcing plate form a deck board of a skid, plural rows of elongated depressions being formed in said main plate, plural rows of elongated depressions being provided in said reinforcing plate in a direction perpendicular to said plural rows of elongated depressions of said main plate, and said flanges of said elongated depressions of said main plate being welded to the reinforcing plate by spot welding.

* * * * *